US005369899A

United States Patent [19]

Reeves

[11] Patent Number: 5,369,899

[45] Date of Patent: Dec. 6, 1994

[54] MAGNETIC NAME PLATE ASSEMBLY

[75] Inventor: Robert V. Reeves, Attleboro, Mass.

[73] Assignee: Reeves Co., Inc., Attleboro, Mass.

[21] Appl. No.: 95,775

[22] Filed: Jul. 21, 1993

[51] Int. Cl.[5] ..... A44C 3/00

[52] U.S. Cl. ..... 40/1.5; 40/621; 24/303

[58] Field of Search ..... 40/1.5, 600, 621; 24/303

[56] References Cited

U.S. PATENT DOCUMENTS

| | | | |
|---|---|---|---|
| 2,389,298 | 11/1945 | Ellis | 40/1.5 |
| 2,397,931 | 4/1946 | Ellis | 24/303 |
| 2,601,424 | 6/1952 | Baker | 24/203 |
| 2,659,169 | 11/1953 | Brennan | 40/621 |
| 4,236,331 | 12/1980 | Mattson | 40/1.5 |
| 4,505,007 | 3/1985 | Aoki | 24/303 |
| 5,283,966 | 2/1994 | Rader et al. | 40/1.5 |

FOREIGN PATENT DOCUMENTS

| | | | |
|---|---|---|---|
| 0999770 | 2/1952 | France | 24/303 |
| 1192817 | 11/1985 | U.S.S.R. | 24/303 |
| 93/20548 | 10/1993 | WIPO | 40/600 |

*Primary Examiner*—Edward K. Look
*Assistant Examiner*—Mark Sgantzos
*Attorney, Agent, or Firm*—Salter & Michaelson

[57] ABSTRACT

A magnetic name plate assembly includes a name plate and a retaining member which are magnetically receivable in face-to-face relation so that a user's garment may be sandwiched therebetween. The name plate and the retaining member are provided with interengaging elements that interlock with the fabric sandwiched therebetween and effectively limit relative movement of one member with respect to the other.

10 Claims, 5 Drawing Sheets

MAGNETIC NAME PLATE ASSEMBLY

BACKGROUND AND SUMMARY OF THE INVENTION

The instant invention relates to name plates and more particularly to a magnetic name plate assembly wherein the name plate is mountable on the user's shirt or other garment by means of magnetic attraction.

Magnetic name plates have heretofore been known in the art. In this regard, the U.S. Pat. No. to Mattson 4,236,331 represents the closest prior art to the subject invention of which the applicant is aware. The Mattson patent discloses a self-adhering badge assembly comprising a pair of separable badge panels which are adapted to be placed in face-to-face relation with a selected area of an article of clothing sandwiched therebetween. Each of the panels has a similar construction and each comprises a magnetic core having N and S poles at opposite ends thereof and a rigid ferromagnetic plate. The magnetic poles on one of the panels are in complementary orientation relative to the poles on the other panel so that the panels are magnetically attractable. The core of each panel is laminated in a plastic film jacket and the outer face of the outer panel includes indicia display means. While the magnetic attraction of the panels somewhat limits relative movement of one panel with respect to the other, it has been found that the panels can easily become slidably detached from each other by simply brushing against the outer panel of the badge assembly. It can be appreciated that when the panels become disassembled, the inner panel falls inside the user's garment where it is often difficult to retrieve.

Also of interest is the U.S. Pat. No. to Ellis 2,389,298 which discloses a magnetic apparel fastener comprising a pair of circular magnets wherein one of the magnets is recessed so that the other magnet interfits within the recess.

The instant invention provides a magnetic name plate assembly comprising a name plate and a retaining member which are magnetically receivable in face-to-face relation so that a user's garment may be sandwiched therebetween. The name plate and the retaining member are provided with complementary interengaging elements that interlock with the garment fabric sandwiched therebetween and effectively limit sliding movement of one member with respect to the other.

Accordingly, it is an object of the instant invention to provide an improved magnetic name plate assembly.

It is another object to provide a magnetic name plate assembly having interengaging elements which limit sliding movement between the name plate and the retaining member.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE PREFERRED EMBODIMENTS

Figure 1:
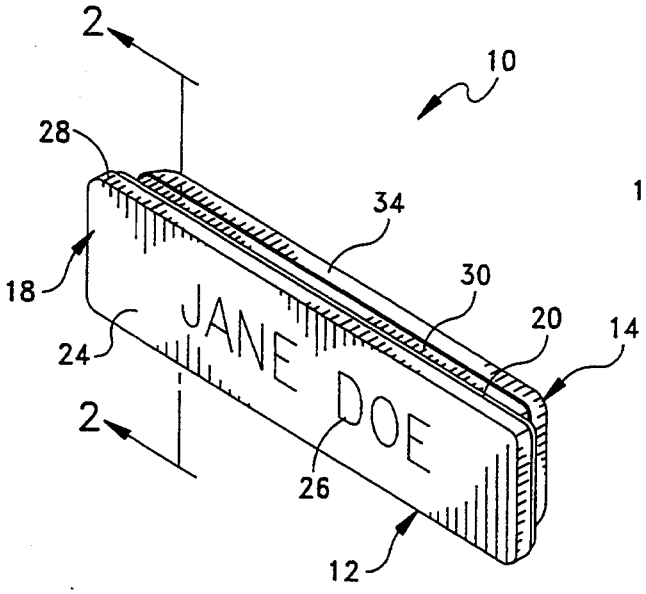
FIG. 1 is a perspective view of a first embodiment of the magnetic name plate assembly of the instant invention.
Figure 2:
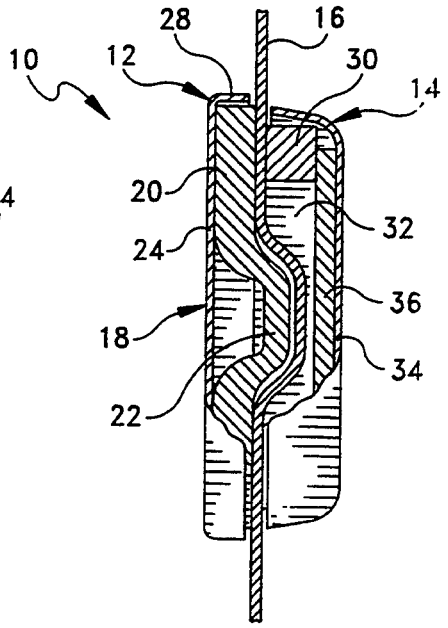
FIG. 2 is an enlarged cross-sectional view thereof taken along line 2—2 of FIG. 1.
Figure 3:
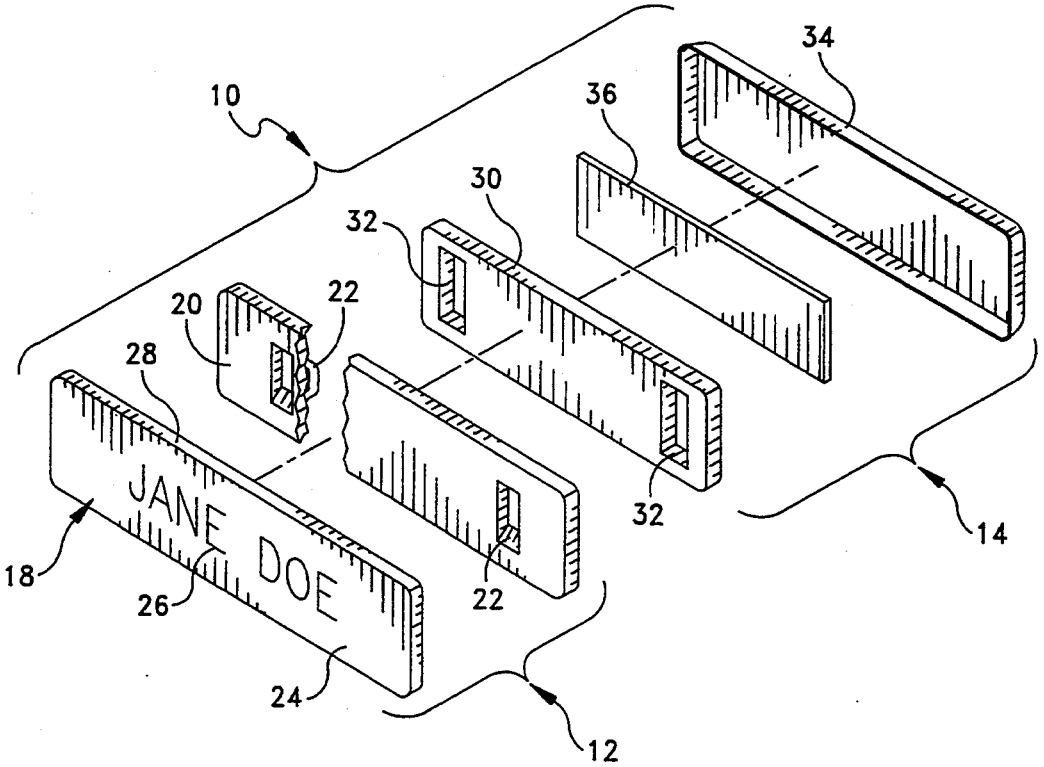
FIG. 3 is an exploded perspective view thereof.

Referring now to the drawings, a first embodiment of the magnetic name plate assembly of the instant invention is illustrated and generally indicated at 10 in FIGS. 1 through 3. As will hereinafter be more fully described, the magnetic name plate assembly 10 includes complementary interengaging elements which are operative for limiting sliding movement between the opposing members of the assembly.

The magnetic name plate assembly 10 comprises a name plate generally indicated at 12 for mounting on the outer surface of a user's garment 16, such as a shirt or a jacket lapel, and a retaining member generally indicated at 14 for mounting on the inner side of the garment 16. The name plate 12 preferably comprises a metallic indicia panel generally indicated at 18 and a ferrous steel plate 20 having a pair of integrally struck protuberances 22 which extend rearwardly adjacent the opposite ends of the plate 20. The indica panel 18 includes a face portion 24 which may be engraved or otherwise provided with indica 26 for displaying a user's name or other information, and it further includes a rearwardly extending marginal lip 28. The steel plate 20 is snugly received inside the lip 28 of the indica panel 18 with an adhesive, such as a double sided adhesive tape (not shown). The retaining member 14 comprises a magnetic strip 30 having a pair of apertures 32 adjacent the opposite ends thereof, a rear panel 34 and a second ferrous steel plate 36 which is received between the magnetic strip 30 and the rear panel 34 as illustrated in FIGS. 2 and 3. The magnetic strip 30, the steel plate 36 and the rear panel 34 are preferably assembled with an adhesive such as a double sided adhesive tape. In use, the name plate 12 and the retaining member 14 are magnetically received in face-to-face relation with a garment fabric 16 sandwiched therebetween and the rearwardly extending protuberances 22 received within the apertures 32 (See FIG. 2). In this regard, the protuberances 22 and apertures 32 engage and interlock with the garment fabric 16 to prevent sliding movement between the name plate 12 and the retaining member 14. It is pointed out that the ferrous steel plates 20 and 36 positioned on opposite sides of the magnetic strip 30 substantially increase the magnetic power of the magnetic strip 30 to provide increased magnetic holding power between the name plate 12 and the retaining member 14. The name plate assembly 10 may be disassembled by grasping the name plate 12 and retaining member 14 and firmly pulling outwardly to overcome the magnetic attraction therebetween.

Figure 4:
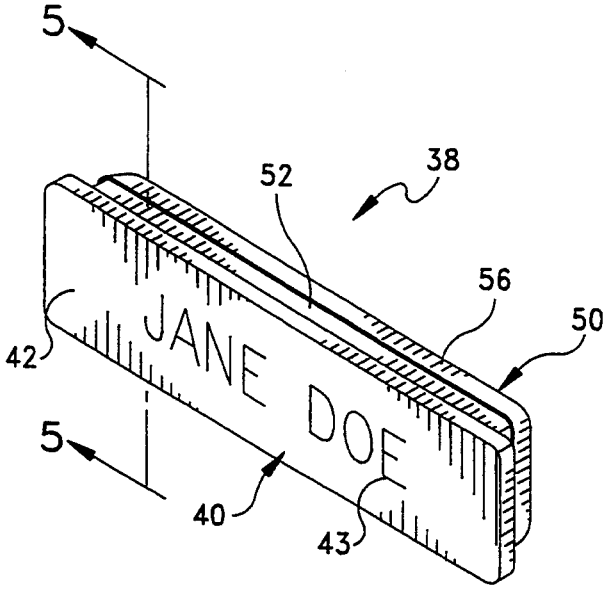
FIG. 4 is a perspective view of a second embodiment of the instant invention.
Figure 5:
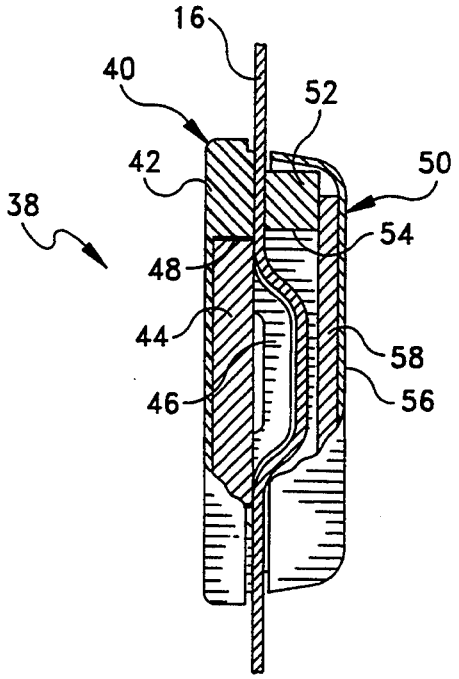
FIG. 5 is an enlarged cross-sectional view thereof taken along line 5—5 of FIG. 4.
Figure 6:
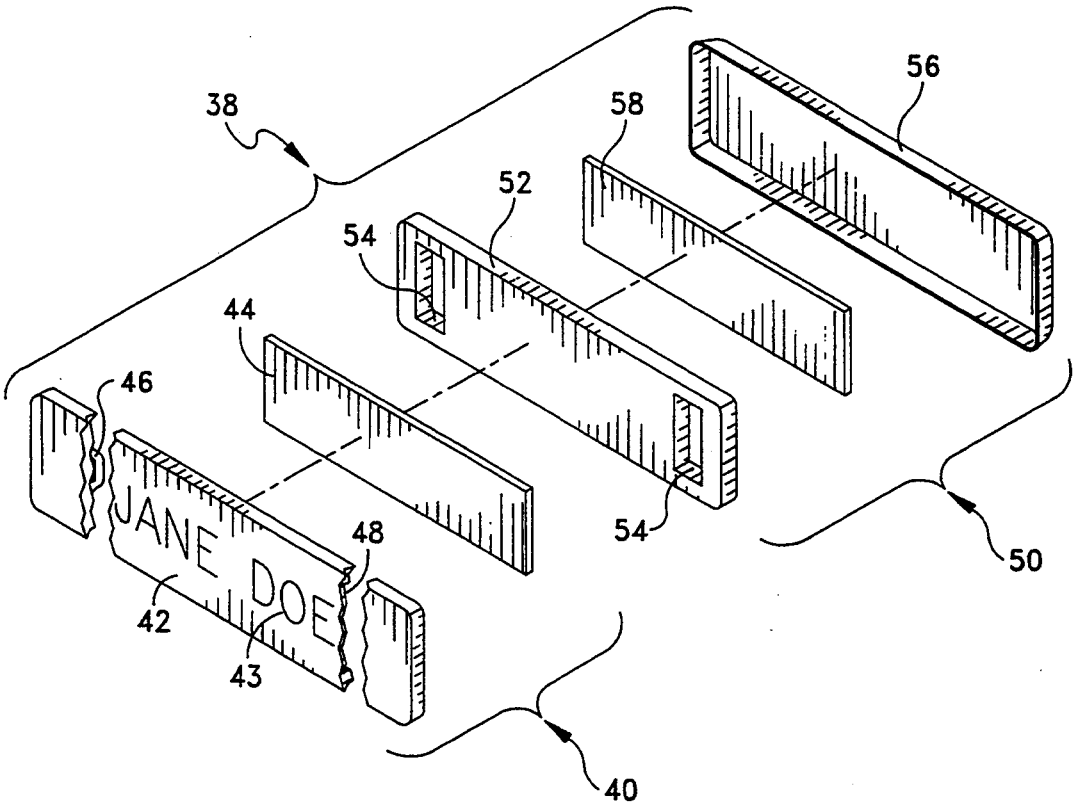
FIG. 6 is an exploded perspective view thereof.

Referring now to FIGS. 4 through 6, a second embodiment of the invention is illustrated and generally indicated at 38. In the second embodiment 38, the name plate is generally indicated at 40 and it comprises a plastic indicia panel 42 which may be provided with indicia 43 by any suitable means, and a ferrous steel insert 44. The indicia panel 42 is integrally formed with a pair of rearwardly extending protuberances 46 (only one shown) adjacent the opposite ends thereof and a rearwardly facing recess 48 formed therein. The steel insert 44 is received and secured into the recess in the indicia plate. The retaining member 50 is identical to the retaining member 14 described hereinabove and it comprises a magnetic strip 52 having a pair of apertures 54 formed adjacent the opposite ends thereof, a rear panel 56 and a ferrous steel plate 58 which is received between the magnetic strip 52 and the rear panel 56. The name plate assembly 38 is assembled in the same manner as described above, however, it can be appreciated that when the name plate 40 and retaining member 50 are received in face-to-face relation, the magnetic strip 52 is magnetically attracted to the ferrous steel insert 44, and the protuberances 46 on the indicia panel 42 are received in the apertures 54 in the magnetic strip 52 (FIG. 5).

Figure 7:
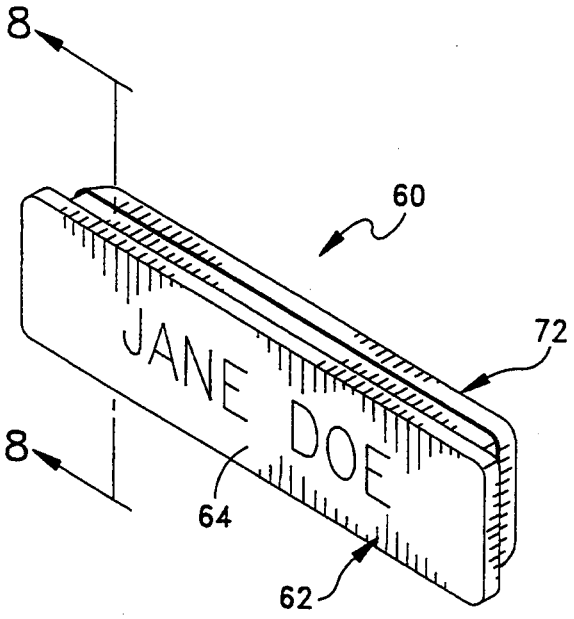
FIG. 7 is a perspective view of a third embodiment of the instant invention.
Figure 8:
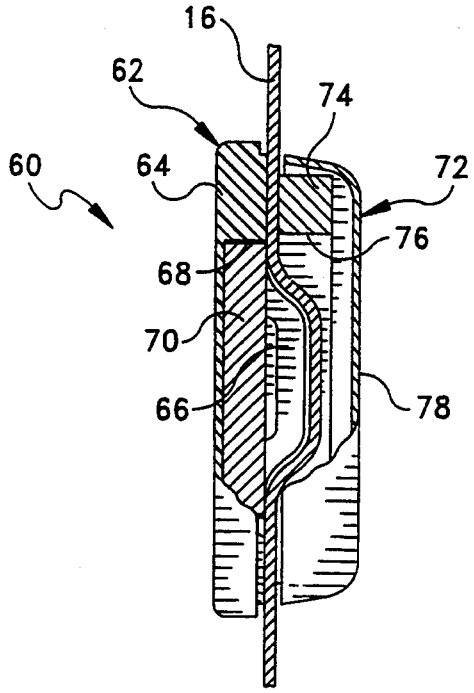
FIG. 8 is an enlarged cross-sectional view thereof taken along line 8—8 of FIG. 7.
Figure 9:
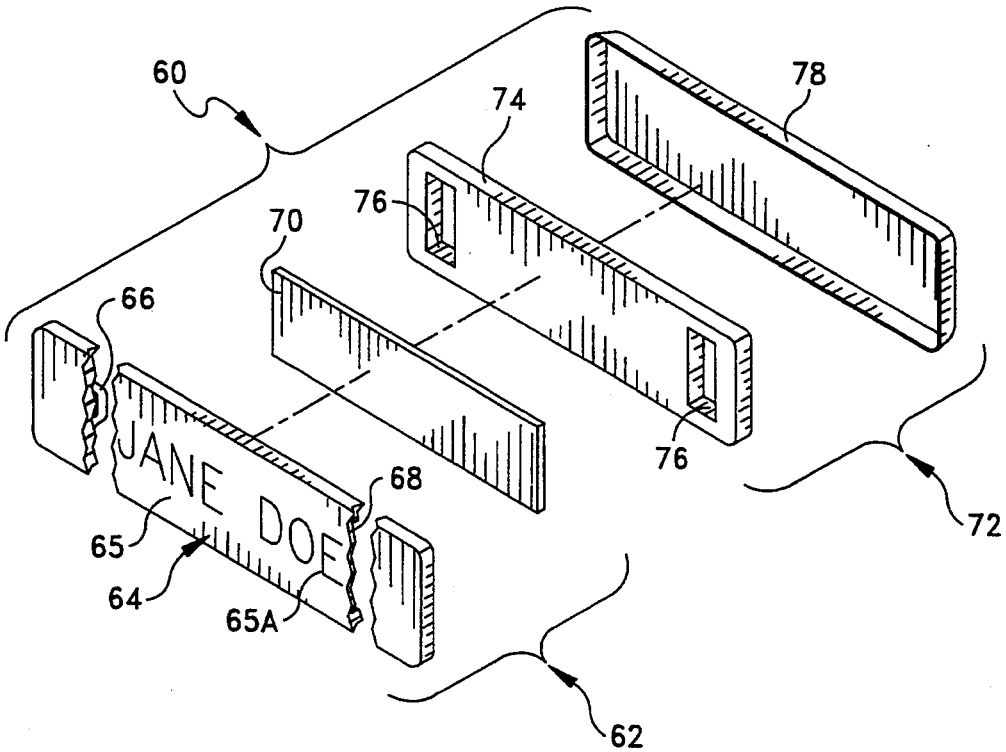
FIG. 9 is an exploded perspective view thereof.

A third embodiment of the invention is illustrated and generally indicated at 60 in FIGS. 7 through 9. In the third embodiment 60, the name plate is generally indicated at 62 and it comprises a plastic indicia panel generally indicated at 64 having a face portion 65 which may be provided with indicia 65*a*, a pair of rearwardly extending protuberances 66, and a recess 68 formed therein. The name plate 62 further comprises a magnetic insert 70 which is received within the recess 68. The third embodiment 60 further includes a retaining member generally indicated at 72 which comprises a ferrous steel plate 74 having a pair of apertures 76 adjacent the opposite ends thereof and a rear panel 78. The ferrous steel plate 74 is snugly attached by an adhesive inside the rear panel 78. In use, the name plate 62 and the retaining member 72 are magnetically received in face-to-face relation with a garment fabric 16 sandwiched therebetween and the rearwardly extending protuberances 66 received within the apertures 76 (See FIG. 8).

Figure 10:
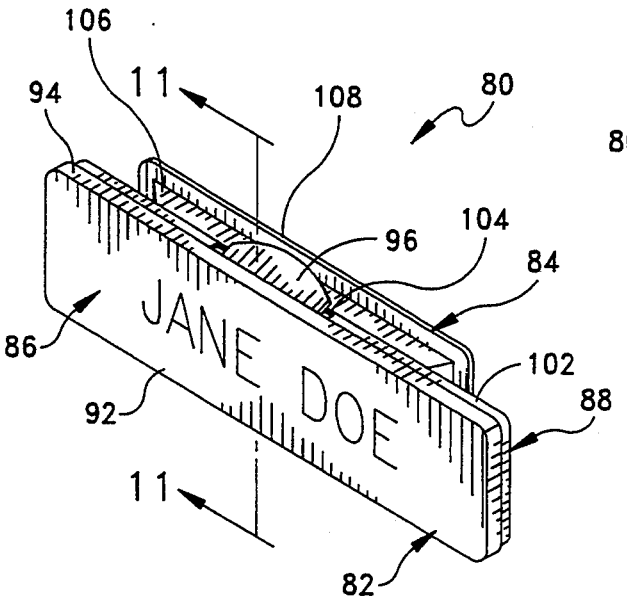
FIG. 10 is a perspective view of a fourth embodiment of the instant invention.
Figure 11:
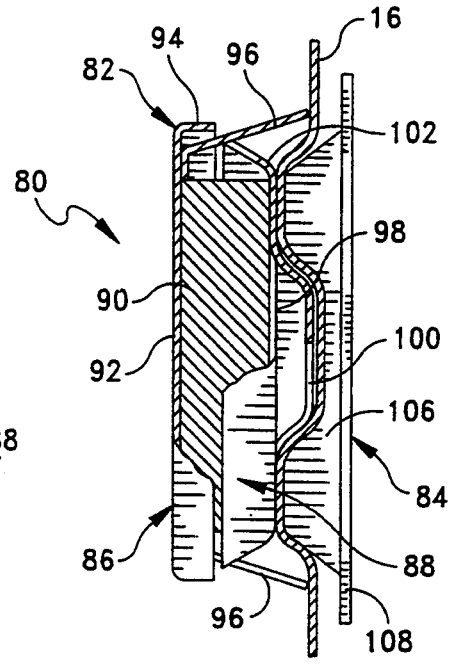
FIG. 11 is an enlarged cross-sectional view thereof taken along line 11—11 of FIG. 10.
Figure 12:
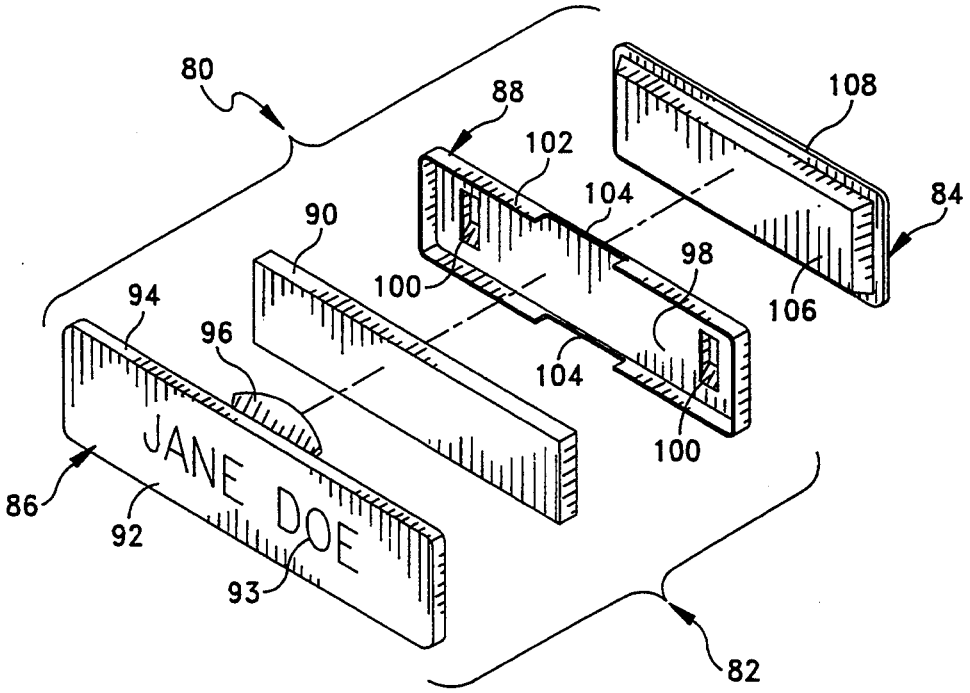
FIG. 12 is an exploded perspective view thereof.

A fourth embodiment of the invention is illustrated and generally indicated at 78 in FIGS. 10 through 12. The fourth embodiment comprises a name plate generally indicated at 80 and a magnetic retaining member generally indicated at 82. The name plate 82 comprises a metallic indicia panel generally indicated at 86, a cover panel generally indicated at 88 and a ferrous steel plate 90 which is sandwiched between the indicia panel 86 and the cover panel 88. The indicia panel 86 includes a face portion 92 which may be provided with indicia 93 by any suitable means, a rearwardly extending marginal lip 94 and a pair of rearwardly extending flanges 96 mounted adjacent the upper and lower edges of the indicia panel 86. The cover panel 88 includes a rear wall 98 having a pair of integrally struck, rearwardly extending protuberances 100 adjacent the opposite ends thereof and a forwardly extending lip 102. It is pointed out that the lip 102 of the cover panel 88 is formed with notches 104 adjacent the upper and lower edges thereof for interfitting engagement of the flanges 96 therein. The magnetic retaining member 84 comprises a magnetic bar which is enclosed in a plastic jacket and it includes a body portion 106 and a flange 108. For use, the retaining member 84 and the name plate 82 are magnetically received in face-to-face relation with a garment fabric 16 sandwiched therebetween, and the body portion 106 of the retaining member 84 received between the upper and lower flanges 96 and the side protuberances 100 so that sliding movement between the name plate 82 and the retaining member 84 is limited. It is pointed out that the protuberances 100 and the flanges 96, and the retaining member 84 engage and interlock with the garment fabric 16 to prevent sliding movement of one member with respect to the other member.

Figure 13:
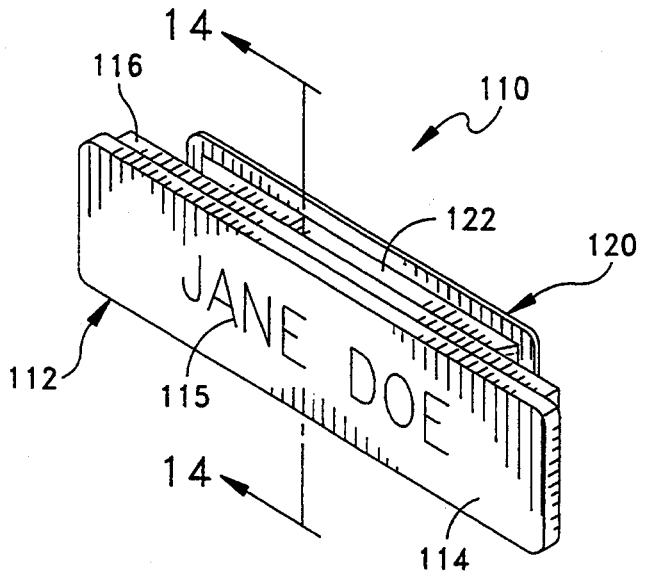
FIG. 13 is a perspective view of a fifth embodiment of the instant invention.
Figure 14:
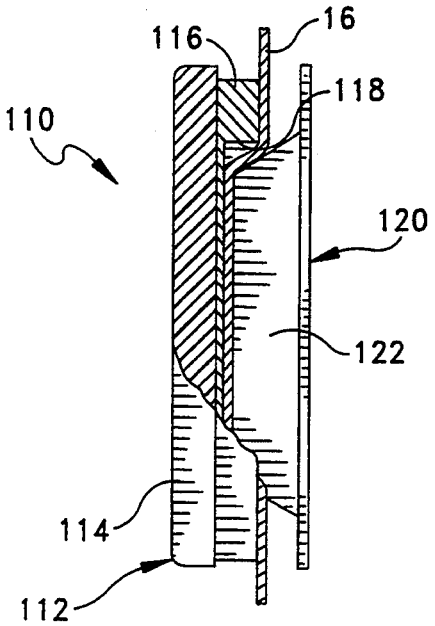
FIG. 14 is an enlarged cross-sectional view thereof taken along line 14—14 of FIG. 13.
Figure 15:
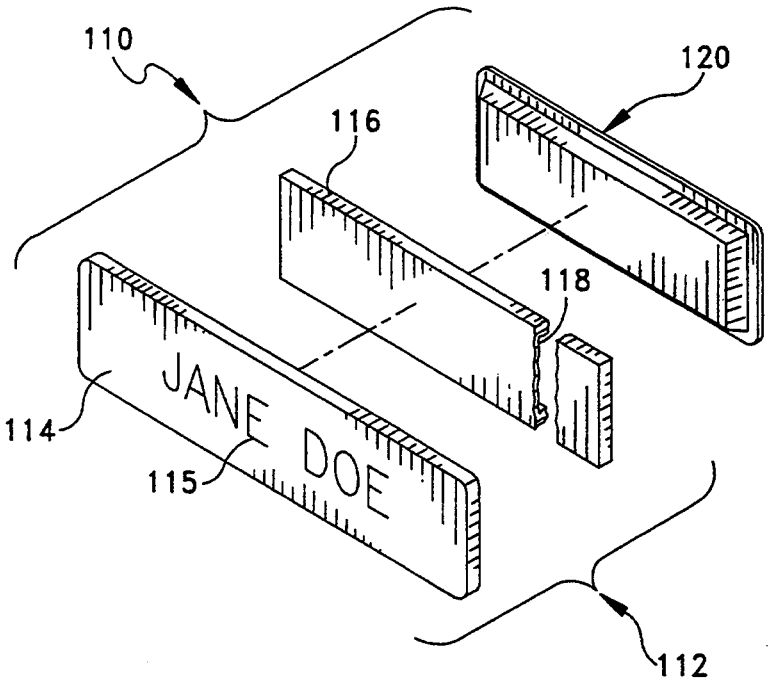
FIG. 15 is an exploded perspective view thereof.

Still another embodiment of the invention is illustrated and generally indicated at 110 in FIGS. 13 through 15. In this embodiment 110 the name plate 112 comprises an indicia panel 114 which may be provided with indicia 115 by any suitable means, and a ferrous steel plate 116 having a rearwardly facing recess 118 formed therein. The fifth embodiment further includes a retaining member 120 which comprises a plastic jacketed magnet as previously described. For use, the body portion 122 of the retaining member 120 is magnetically received within the recess 118 in the steel plate 116 with a garment fabric 16 sandwiched therebetween. The edges of the recess 118 and the body portion 106 of the retaining member 104 interlock with the garment fabric 16 to prevent sliding movement between the name plate 112 and the retaining member 120.

It can therefore be seen that the instant invention provides a plurality of novel and unique magnetic name plate assemblies. In each embodiment, the name plate and the retaining member include complementary interengaging means which limit sliding movement of one member with respect to the other member, and they are magnetically receivable in face-to-face relation with a garment fabric sandwiched therebetween. In three of the embodiments, rearwardly extending protuberances on the name plate are received within corresponding apertures in the retaining member. Another embodiment includes a recessed back and the body portion of a retaining member is received within the recess. In yet another embodiment, the name plate is provided with opposing flanges and protuberances, and the body portion of a magnetic retaining member is received between the flanges and protuberances. In each of the embodiments, the interengaging elements interlock with the garment fabric sandwiched therebetween to prevent sliding movement between the name plate and the retaining member. In addition, each of the assemblies is easily disassembled by grasping the opposing members and firmly pulling outwardly to overcome the magnetic attraction therebetween. For these reasons the magnetic name plate assembly of the instant invention is believed to represent a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

I claim:

1. A magnetic name plate assembly comprising:

a name plate for mounting on the outer side of a garment, said name plate including means for displaying indicia thereon;

a retaining member for mounting on the inner side of said garment, said retaining member and said name plate being magnetically receivable in face-to-face relation with said garment sandwiched therebetween; and interengaging means on said retaining member and said name plate for limiting relative movement of the name plate with respect to the retaining member;

said interengaging means comprising a pair of rearwardly extending flanges at upper and lower edges of said name plate and a pair of protuberances extending rearwardly adjacent opposite ends of said name plate, said retaining member being receivable between said flanges and said protuberances so that sliding movement between said name plate and said retaining member is limited.

2. In the magnetic name plate assembly of claim 1, said name plate member including a ferrous steel plate, said retaining member comprising a magnet which is receivable between said flanges and said protuberances.

3. In the magnetic name plate assembly of claim 2, said magnet being enclosed in a plastic jacket.

4. A magnetic name plate assembly comprising:

a name plate for mounting on the outer side of a garment, said name plate including means for displaying indicia thereon;

a retaining member for mounting on the inner side of said garment, said retaining member and said name plate being magnetically receivable in face-to-face relation with said garment sandwiched therebetween; and interengaging means on said retaining member and said name plate for limiting relative movement of the name plate with respect to the retaining member;

said interengaging means comprising a pair of protuberances extending rearwardly adjacent opposite ends of said name plate and a pair of apertures adjacent opposite ends of said retaining member, said protuberances being receivable in said apertures so that sliding movement between said name plate and said retaining member is limited.

5. In the magnetic name plate assembly of claim 4, said name plate including a ferrous steel plate having said protuberances integrally formed thereon, said retaining member including a magnetic strip having said apertures formed therein.

6. In the magnetic name plate assembly of claim 4, said name plate including a magnetic strip, said retaining member including a ferrous steel plate having said apertures formed therein.

7. A magnetic name plate assembly comprising:

a name plate for mounting on the outer side of a garment, said name plate including means for displaying indicia thereon;

a retaining member for mounting on the inner side of said garment, said retaining member and said name plate being magnetically receivable in face-to-face relation with said garment sandwiched therebetween; and interengaging means on said retaining member and said name plate for limiting relative movement of the name plate with respect to the retaining member;

said interengaging means comprising a rearwardly facing recess in said name plate, said retaining member being receivable in said recess so that sliding movement of said name plate and said retaining member is limited;

said name plate including a ferrous steel plate having said recess formed therein, said retaining member comprising a magnet which is receivable in said recess.

8. In the magnetic name plate assembly of claim 7, said magnet being enclosed in a plastic jacket.

9. A magnetic name plate assembly comprising:

a name plate including an indicia panel and a ferrous steel plate having rearwardly extending protuberances adjacent opposite ends thereof; and a retaining member including a magnetic strip having a pair of apertures formed therein adjacent opposite ends thereof, a cover panel and a ferrous steel plate positioned between said magnetic strip and said cover panel, said name plate and said retaining member being magnetically receivable in face-to-face wherein said rearwardly extending protuberances are received in said apertures so that sliding movement between said name plate and said retaining member is limited.

10. A magnetic name plate assembly comprising:

a name plate including an indicia panel, a pair of flanges extending rearwardly from upper and lower edges of said indicia panel, a rear panel having rearwardly extending protuberances adjacent opposite ends thereof, and a ferrous steel plate received between said indicia panel and said rear panel; and a retaining member comprising a magnetic bar which is enclosed in a plastic jacket, said name plate and said retaining member being magnetically receivable in face-to-face relation wherein said retaining member is received between said flanges and said protuberances so that sliding movement between said name plate and said retaining member is limited.

* * * * *